US008915305B2

(12) United States Patent
Burgos

(10) Patent No.: US 8,915,305 B2
(45) Date of Patent: Dec. 23, 2014

(54) DOWNHOLE PACKER TOOL WITH SAFETY SYSTEMS FOR PREVENTING UNDUE SET AND RELEASE OPERATIONS

(75) Inventor: Horacio Daniel Burgos, Cipolletti (AR)

(73) Assignee: Texproil S.R.L. (AR)

( * ) Notice: Subject to any disclaimer, the term of this patent is extended or adjusted under 35 U.S.C. 154(b) by 725 days.

(21) Appl. No.: 13/185,479

(22) Filed: Jul. 18, 2011

(65) Prior Publication Data

US 2012/0160523 A1 Jun. 28, 2012

(30) Foreign Application Priority Data

Dec. 28, 2010 (AR) ..... P100104972

(51) Int. Cl.
*E21B 33/12* (2006.01)
*E21B 33/129* (2006.01)

(52) U.S. Cl.
CPC ..... *E21B 33/129* (2013.01); *E21B 33/1293* (2013.01)
USPC ..... 166/387; 166/182; 166/217; 166/179; 166/118

(58) Field of Classification Search
USPC ..... 166/182, 187
See application file for complete search history.

(56) References Cited

U.S. PATENT DOCUMENTS

| | | | | |
|---|---|---|---|---|
| 4,441,559 | A * | 4/1984 | Evans et al. | 166/382 |
| 4,834,175 | A * | 5/1989 | Ross et al. | 166/120 |
| 5,103,902 | A * | 4/1992 | Ross et al. | 166/120 |
| 5,141,053 | A | 8/1992 | Restarick | |
| 5,180,010 | A | 1/1993 | Stout | |
| 6,554,076 | B2 * | 4/2003 | Guillory et al. | 166/387 |
| 7,861,791 | B2 * | 1/2011 | Kilgore et al. | 166/120 |

* cited by examiner

*Primary Examiner* — Jennifer H Gay
*Assistant Examiner* — Caroline Butcher
(74) *Attorney, Agent, or Firm* — Baker & McKenzie LLP

(57) ABSTRACT

A packer tool has safety devices to prevent premature and reverse setting and release operations. The safety devices are independent of shear-pin safety systems. Confined annular segments prevent a setting actuator piston from moving absent tool-setting hydraulic pressure. The setting pressure first moves a cylinder in an opposite direction to unroof the segments allowing them to exit confinement and free the piston to set the packing and the anchor slips. Release safety pins extend radially inward from a packing-holder collar into short slots formed on a mandrel surface, preventing the mandrel from being turned. Previous set motion causes the pins to leave the slots thereby freeing the mandrel to turn only after the tool has been set. A third safety device comprises an expanded ring which is dragged by the release cone during release motion until it lodges in a circumferential groove in the mandrel, locking against reverse movement.

22 Claims, 8 Drawing Sheets

DOWNHOLE PACKER TOOL WITH SAFETY SYSTEMS FOR PREVENTING UNDUE SET AND RELEASE OPERATIONS

CROSS-REFERENCE TO RELATED APPLICATIONS

This patent application claims the benefit of the priority of Argentine patent application serial number P100104972 filed on Dec. 28, 2010.

STATEMENT REGARDING FEDERALLY SPONSORED RESEARCH OR DEVELOPMENT

Not Applicable.

REFERENCE TO SEQUENCE LISTING, A TABLE OR A COMPUTER PROGRAM LISTING COMPACT DISC APPENDIX

Not Applicable.

BACKGROUND OF THE INVENTION

The present invention concerns tools for borehole applications, in particular oil wells, gas wells or water-wells, more particularly including installations for primary, secondary or tertiary oil production, whether holes for injecting water, gas or another pressurizing agent (injector holes) or oil extraction (production wells). A particular application of the tool is in injector and producer multi-zone wells where the number of isolation zones is high and/or the wellbore casing is damaged or diverted, to quickly and economically isolate areas with damaged casing.

The present invention applies to tools carrying a packer device comprising seals mounted to a mandrel and forming with other operational components a tubing string (or just "tubing") of tools and components joined one after another for lowering down a multifunctional (or multizonal) well, i.e. having multiple layers or strata which should be isolated from one another. Packer tools are not unusual in the oil industry. The tubing string comprising a number of function-specific tools is lowered into a well, maintaining an annular space between the tubing string and a well casing.

Packer tools generally comprise two basic elements: packer seals for isolating annular regions thereabove and below and anchor slips to affix the tool to a point of the casing. A packer sealing element is a ring made of metal and typically dense synthetic rubber that fits around the tubing in a well. The packer seal (the "packing element") of a packer tool (the "packer") is typically a rubber ring that expands against the side of the casing lining the side of the wellbore. A packer may, and usually will, have more than one packing element. In the majority of active wells in the world today, this tubing is used to either produce oil or gas out of the well and serve as a conduit to transport water into the well for water injection and water flood applications. The packer provides a secure packer seal between everything above and below where it is set. The main reasons for using a packer are to keep sediment, sand and other potentially corrosive or erosive materials from flowing into the annulus and damaging the casing, and to control the zone of the well from which hydrocarbons are being produced in a producer well or to control the zone where water is being injected in an injection well.

Slips hold the packer in place and prevent them from moving once they are set in the well. A slip is a serrated piece of metal that grips the side of the casing. Some packers lack a specific anchor device (in which case they are known as packer-tandems).

Insofar as the present invention is concerned, the packer tool sequentially carries out the following phases:

Run-in: The tubing enters the well and the packer is lowered down to a set position.

Setting: Both the anchor slips and the packer seals are pushed outwards to respectively clamp the tool to the well while the tubing is down the well, isolating annular regions above and below the packer. The tool setting system may be mechanical, involving rotation or axial compression or traction, or else hydraulic by injecting a pressurizing fluid.

Release: This operation is carried out on removable tools to unset them from the well casing in order that they may be extracted. In tools having release systems, known as removable packers, release may be based on similar maneuvers or a combination thereof. Tools lacking a release system are known as permanent packers which need to be rotated to literally destroy the tool by machine milling. This operation is costly and time-consuming.

Extraction: The removable packer is hauled up to the mouth of the well.

The invention particularly relates to a packer tool that is removable, hydraulically set and mechanically released.

The present invention concerns packer tools—whether of the tandem type or not (i.e. without or with anchor devices), in particularly regarding safety features thereof for preventing accidental operations during the run-in, dwelling time and extraction from the well. More particularly, they refer to the sequence and time-frames involved in different operational movements which involve the packer seals—as well as the anchor means if present—to convey reliability to the tool operation, avoid undue movements causing the sequence to untimely jump ahead or go back at any time.

Use of mechanically- or hydraulically-actuated packer tools or, simply, packers for maintaining separation between production layers or fluid injection layers is well known in the oil industry.

The best known release systems are by rotation and traction. In the first system, the tool is released by rotating it several turns, which complicates the operation the deeper in the well because of the greater number of tools. This in turn makes the operation unreliable through uncertainty regarding which tool is actually being operated.

In traction release, tractive tension is applied to the piping to shear a number of brass or steel pins. Once set, this kind of tool is subject to stress from temperature and pressure variations down the well, which get worse with increased depth to the point that pins may shear producing accidental tool release.

U.S. Pat. No. 4,319,639 (Mott) and U.S. Pat. No. 4,832,129 (Sproul et al) are examples of the use of shear pins to prevent undue setting and release of the tool. The problem with shear pins is, precisely, that they are designed to fail when subjected to calculated shear forces. Sufficient shear forces may arise in unforeseen circumstances such a from jarring during run-in and downhole temperature-induced tool-length expansion and pressure surges.

In some operations, in which the tool has to be moved upwards for some reason, the setting anti-shear pins may fail leading to accidental tool setting. This may occur when for some reason (coupling, paraffin, casing failure, etc.) the packer or the packing mechanism receives a longitudinal up-to-down force, generally applied to the greater tool diameter, i.e. one of the calibrator rings, and transmitted to the setting shear pins which break off thereby undesirably setting the tool.

U.S. Pat. No. 4,834,175 (Ross & White) discloses a well packer with annular packing seals and anchor slips with a hydraulic setting actuator in between. The actuator includes a piston for setting the slips and a cylinder for setting the seal elements. A snap ring prevents the piston and cylinder from moving away from each other while they are mechanically interlocked thus preventing premature setting of the tool.

Some prior art packers have a split-mandrel system having several drawbacks. One such drawback is pasting of the screw-threads joining two mandrels thereby causing difficulties in tool release. Moreover, the release mechanism in split-mandrel systems tend to be unreliable. Another drawback thereof is dead time during the release operation during which the tool turns freely and are uselessly unable to transmit torque down to other tools in the tubing.

When connecting the packing device between upper and lower tubings at the mouth of the well, it is necessary to adjust them by turning the joints of the subs with the tubings in opposite directions, that is to carry out a counterscrew. Some packer tools may suffer a sudden accidental "release" when carrying out this maneuver and may not operate any further. Moreover, if the sudden "release" happens before setting, the tool may not be set later and operation is hampered thereafter.

Stresses caused by pressure and temperature variations as a result of changes and movements of flow control valves may affect the packer release mechanisms operating with pins, accidentally releasing some tools and hindering operation thereafter.

U.S. Pat. No. 5,141,053 (Restarik & White) discloses a packer with expandable seal and slip anchoring assemblies. Each anchor slip includes curved upper and lower gripping surfaces positioned to radially expand through cage windows. Radially retractile locking dogs prevent premature tool setting and release. The fact that the dogs are in an extended position protruding from the tool surface during tool run-in and extraction may hinder transit down and up a borehole.

BRIEF SUMMARY OF THE INVENTION

An object of the invention is to provide a packer applicable to tools with dual-slips and hydraulic setting to overcome the above-mentioned prior art problems, thereby providing a packer having simple and reliable setting and release systems, converting it into a highly recommendable tool for installations with multiple packers, useful for selective water injection, selective oil production or gas lift.

In particular, three important objects are pursued by the present invention regarding proper sequential and timely operation: first, to prevent spontaneous setting during run-in of the tool; second, to substantially reduce effects on the release mechanism of temperature and pressure (whether inside or outside the tubing) variations; and third, to prevent the packer from setting again once it has been released so as not to hamper or impede tool movements inside the casing. The first two of these objects refer to avoiding premature transitions to operational states which necessarily need to be carried out later on in the schedule and the third to prevent a retro-transition to an earlier state previously duly exited, in all cases involving faults in the sequence and times of fundamental tool operations which may cause serious and costly problems, which on occasions may not be fixed, regarding maneuverability and operatively of the tubing string. The present invention looks to overcome all these problems in a manner that does not depend solely on safety shear pins susceptible to failure either accidentally or because of downhole pressure conditions—or because of jarring, vibrations or temperature, but rather in a manner that is relatively immune to such mechanical and physical conditions.

Setting of the present packing device is carried out by application of hydraulic pressure inside the tool. The tool of the present invention has a safety system virtually immune to shear forces thereby preventing accidental setting during run-in. Hence the tool may be maneuvered as many times as necessary, both upwards and downwards, without fear of unwittingly setting the tool, thereby eliminating the eventual need to release the packer from an undesired setting and remove it from the well since it has become useless. This anti-setting safety device may only be disabled by application of the hydraulic pressure necessary to set the tool.

The setting mechanism comprises a piston actuator. The anti-setting safety device comprises segments of a suitable shape and size interlocking the piston to the tool mandrel during run-in, during which they are confined by a cylinder such that they have no room to move. When a tool-setting pressure is initially to the piston and cylinder combination via a hydraulic chamber, the piston cannot move until the cylinder displaces in the opposite axial direction. As it is displaced, a space formed on the inside of the cylinder such as by a stepped or conical body portion, draws level with the segments making room for them to exit their combination and free the piston to actuate the setting mechanism.

In addition, accidental release of the packer of the present invention at the mouth of the well or during run-in is also avoided by anti-release pins acting on the mandrel, allowing rotary forces to be applied in opposite directions between the upper and lower subs, without the risk of undue release. Distinct from packer tools currently in use, release does not depend solely on brass or steel shear pins or on several rotary turns of the mandrel. Therefore, internal or external tubing pressures will not cause the tool to release notwithstanding that actual release may be carried in due time in a quick and simple manner. Release is carried out by turning the tool less than a full turn, preferably less than half a turn, more preferably less than a one-quarter turn, such as by a 60° rotation. Snugs (or guide pins) are machined on the mandrel to prevent the mandrel from rotating and, hence, accidental release of the tool. When the mandrel is turned 60°, the packer is immediately released in a simple, quick and efficient manner, resulting in time and money savings compared to other packers on the market.

After release, an upper packer according to the invention is able to transmit torque, traction and weight to a lower packer enabling release of all packers below it without difficulty, thereby contributing to additional savings in operational times and costs.

BRIEF DESCRIPTION OF THE DRAWINGS

The accompanying drawings help to convey features of the present invention and advantages thereof by means of a preferred embodiment. In the drawings:

FIG. 1A is a view half elevation and half axial-section of a preferred embodiment of a packer tool according to the present invention, in an initial position ready for run-in;

FIG. 2A is a magnified half-axial section view of the hydraulic mechanism of the packer tool of FIG. 1A with its chamber, piston and cylinder in the initial position for run-in;

In all the figures like reference numbers identify like tool parts.

DETAILED DESCRIPTION OF THE INVENTION

Figure 1A:
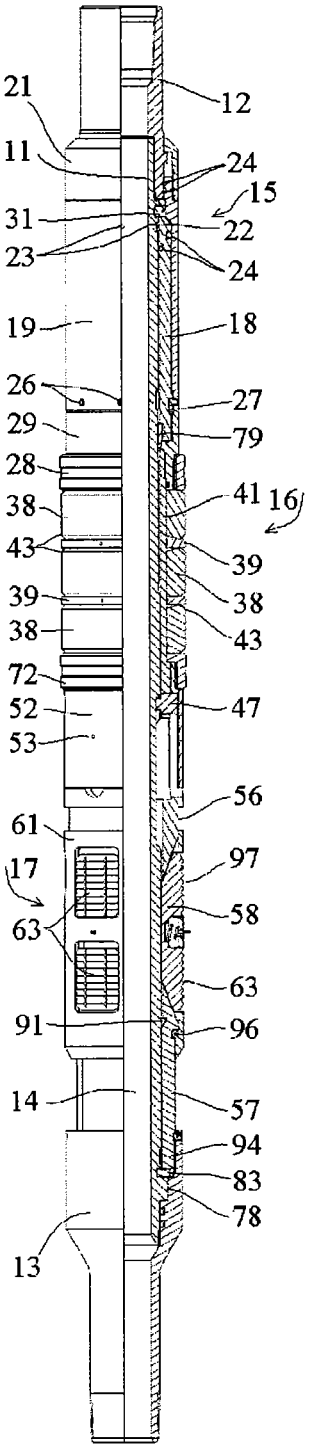
Figure 1B:
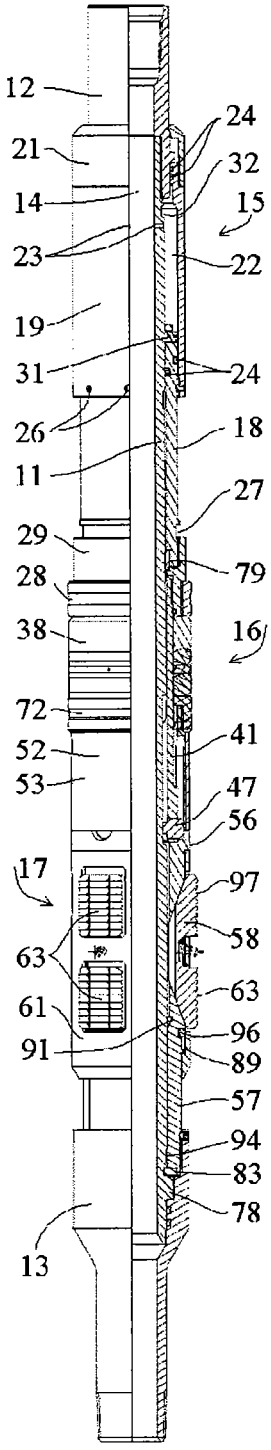
FIG. 1B is a view analogous to FIG. 1A but with the tool in the set position.
Figure 1C:
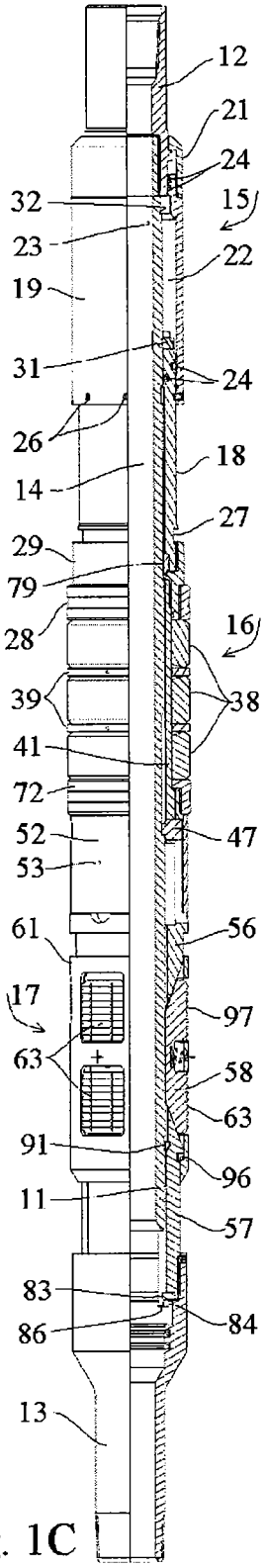
FIG. 1C is a view analogous to FIGS. 1A and 1B but with the tool in the released position, ready for extraction, after its mandrel has turned 60°.

A packer tool or "packer" having a nominal diameter of, e.g., 5½" (139 mm) is depicted in FIG. 1A (notwithstanding that the invention may encompass other standard tool sizes such as 7", 9⅝", etc.). The packer includes a mandrel 11 made of ASTM A519 steel type 4140-Y80 crowned, above, by an upper sub 12 and, below, by a lower sub 13. The three components 11; 12 and 13 are made of SAE 4140 tempered steel and, together, span a tool length of about 1.4 meters. A central bore 14 about 50.8 mm (2") in diameter axially traverses the mandrel 11.

The upper and lower subs 12, 13 are provided with threaded joints for connecting other tubing components above and below prior to the run-in operation. This arrangement allows torque to be transmitted down the length of the tool and, during run-in down a well, allows maneuvering of the entire tubing.

Figure 2A:
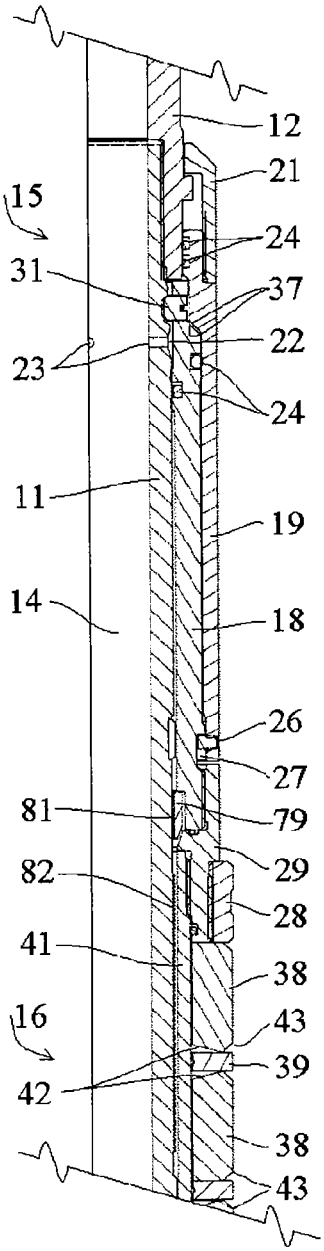
Figure 2B:
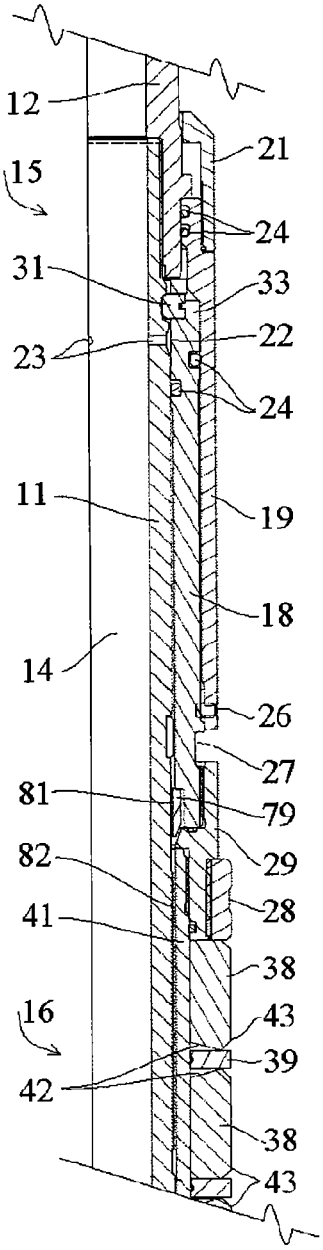
FIG. 2*b* is a magnified view analogous to FIG. 2A but wherein the safety device guarding against premature setting has been disabled during the transition to setting the tool.
Figure 2C:
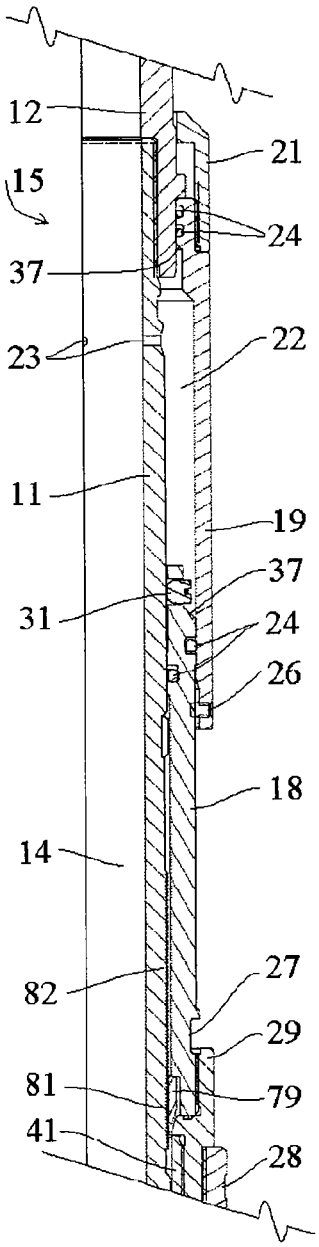
FIG. 2C is a magnified view analogous to FIGS. 2A and 2B but wherein the hydraulic mechanism has reached the final setting position and is stable.
Figure 3A:
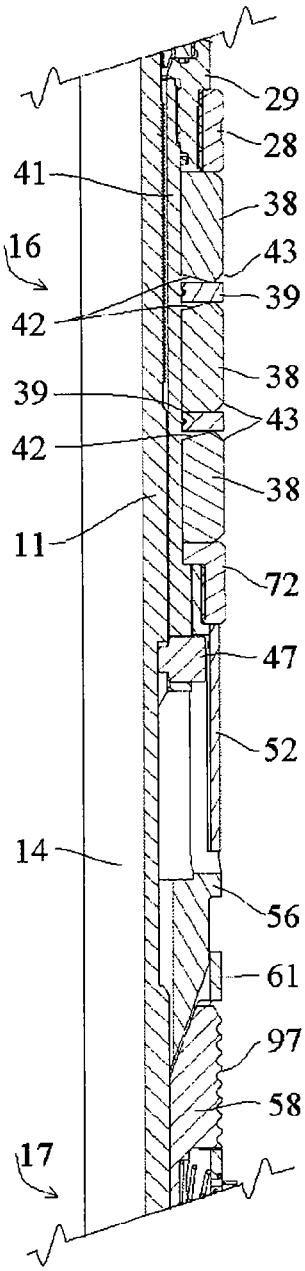
FIG. 3A is a magnified half-axial section view of the packing mechanism of the packer tool of FIG. 1A in the initial run-in position.
Figure 3B:
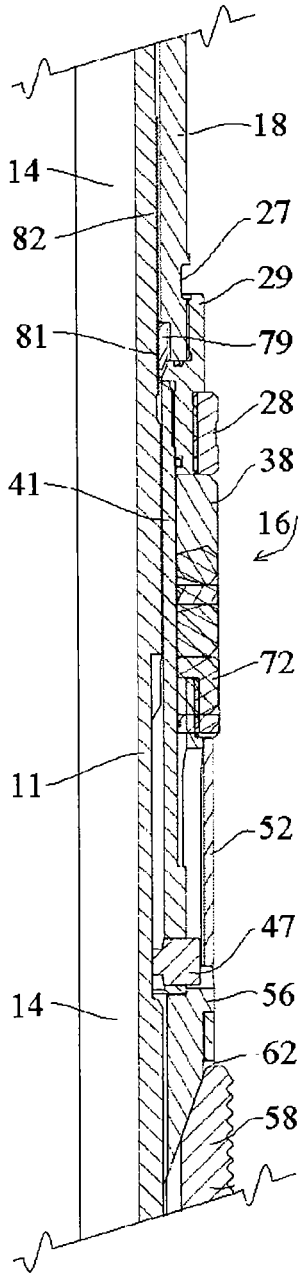
FIG. 3B is a magnified view analogous to FIG. 3A except that the packing mechanism is now in the set position.
Figure 3C:
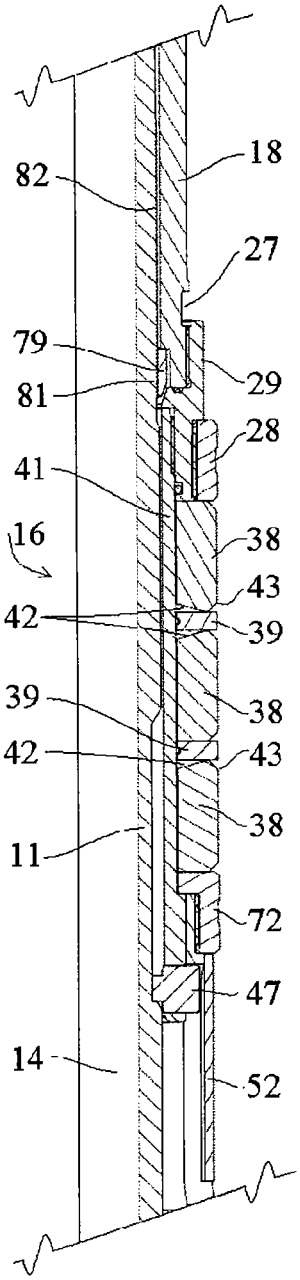
FIG. 3C is a magnified view analogous to FIGS. 3A and 3B but wherein the mandrel has been turned 60° to release the packing mechanism.
Figure 4A:
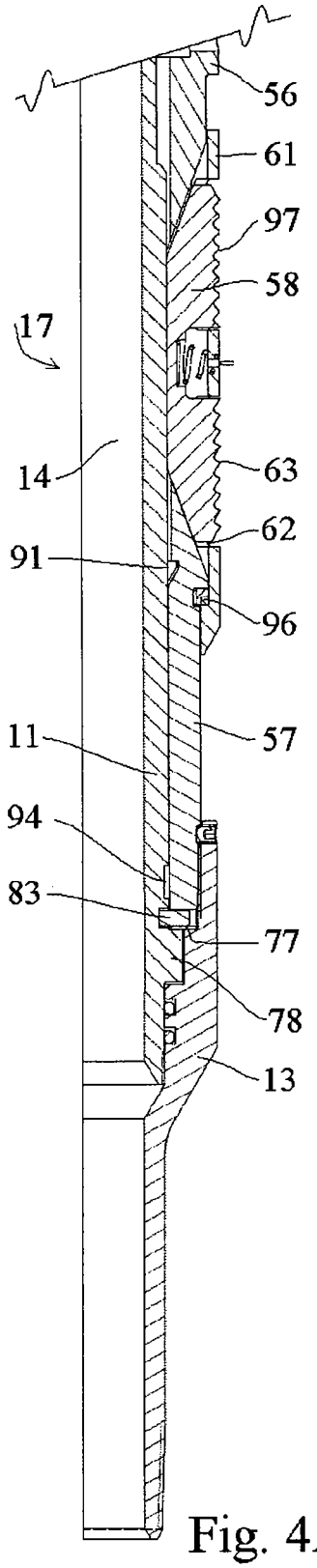
FIG. 4A is a magnified half-axial section view of the anchor mechanism of the packer tool of FIG. 1A in the initial run-in position.
Figure 4B:
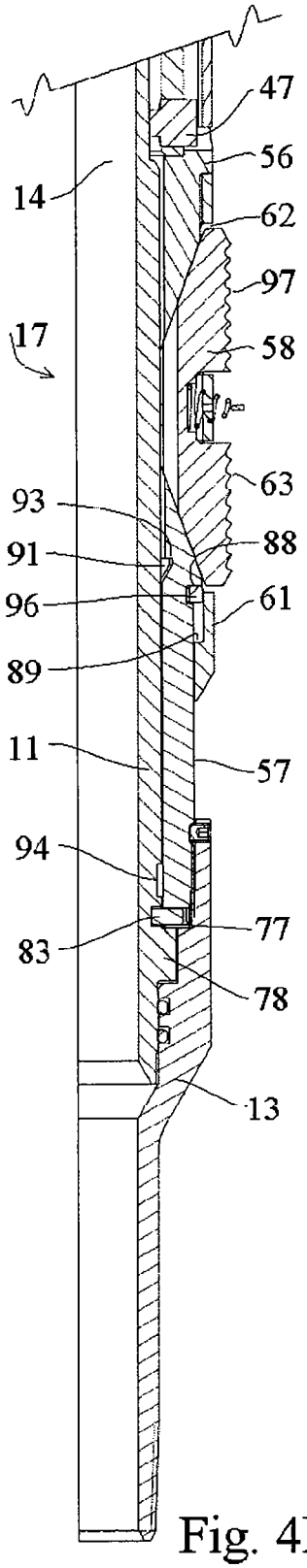
FIG. 4B is a magnified view analogous to FIG. 3A except that the anchor mechanism is now in the set position.
Figure 4C:
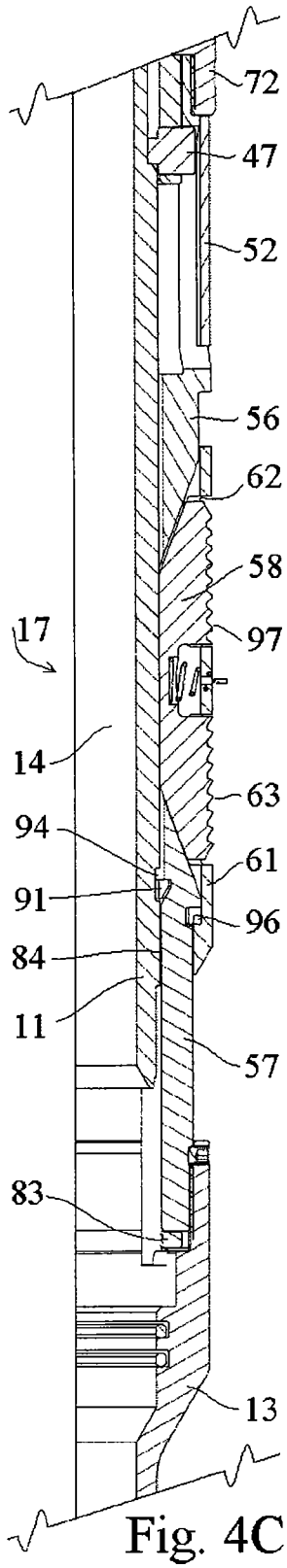
FIG. 4C is a magnified view analogous to FIGS. 3A and 3B but wherein the mandrel has been turned 60° as in FIG. 3C to release the anchor mechanism.

About the mandrel 11 and between the subs 12 and 13 the tool further includes, from top to bottom, a hydraulic mechanism 15 depicted in FIGS. 2A, 2B and 2C for setting the tool, a packing mechanism 16 depicted in FIGS. 3A, 3B and 3C for isolating well layers and an anchor mechanism 17 depicted in FIGS. 4A, 4B and 4C for keeping the tool affixed to a point in the well while it dwells therein.

The hydraulic tool setting mechanism 15 of FIG. 2A comprises a hydraulic piston 18 arranged around the upper part of the mandrel 11 to carry out a downward movement during the set operation. The piston 18 is surrounded by a hydraulic cylinder 19 at the top of which a hanger cap 21 is screwed on to prevent it from descending. The piston 18 functions as an actuator during the set operation, when in moves downwards to the position depicted in FIG. 2B to activate the packing and anchor mechanisms 16-17 as described further on hereafter.

A hydraulic chamber 22 is formed about the top of piston 18 to receive pressurized fluid for activating setting through passages 23 that communicate it with the central bore 14 of the mandrel 11. The hydraulic chamber 22 is closed in by the upper sub 12, the mandrel 11, the hydraulic cylinder 19, the piston 18 and packer seals 24.

Shear pins 26 screwed into the hydraulic cylinder 19 and penetrating through to a slot or depression 27 formed on the outer surface of the piston 18 convey reliability to the setting operation by preventing the latter from moving downwards in absence of sufficient hydraulic pressure in the chamber 22. To proceed with the set operation once the tool has been run-in down the well, fluid is injected at a predetermined pressure from the mouth of the well into the mandrel bore 14 such that it enters the radial passages 23 and fills the chamber 22. The effect of this pressure is to urge the piston 18 downwards to the position depicted in FIG. 2C as described further on herein, after shearing the threaded pins 26 which are dimensioned to said predetermined setting fluid pressure.

In this embodiment, the threaded pins 26 are made of brass, about ¼" (6.35 mm) in diameter and the setting pressure is predetermined according to the number of threaded pins 26, e.g., 400 psi (2.8 MPa) per pin 26. The piston 18 and its threaded pins 26 are protected from damage by the hanger cap 21 during upward maneuvering of the tubing through zones of restricted diameter in the casing.

Figure 5A:
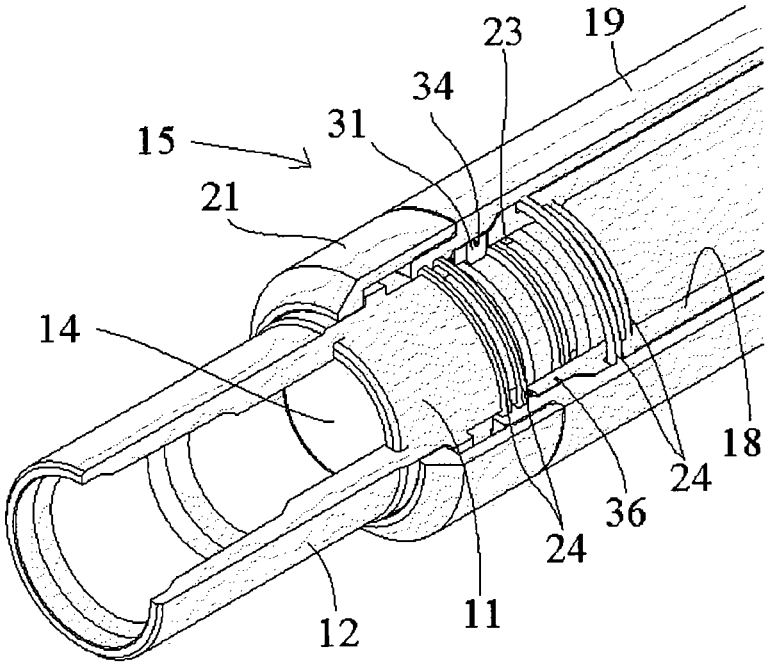
FIG. 5A is a perspective view of the hydraulic mechanism of the tool of FIG. 2A wherein a quadrant of the view has been removed to show the annular segments of the anti-setting mechanism in place in their initial position according to the present invention.
Figure 6A:
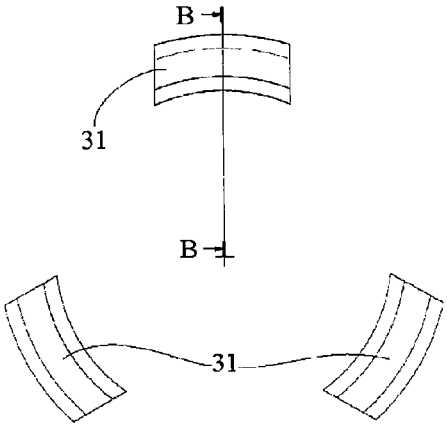
FIG. 6A shows the circumferential distribution of the annular segments which make up the anti-setting safety mechanism of FIGS. 2 and 5 (alphabetic suffices are omitted from figure and reference numbers in the present description to indicate generalization) according to the present invention, wherein some components such as O-rings have been omitted for the sake of clarity.
Figure 6B:
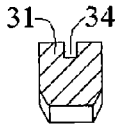
FIG. 6B is a cross-section of an annular segment of FIG. 6A.

However, I have seen that during run-in the pins 26 may be exposed to shear forces in absence of hydraulic pressure, caused by a calibrating ring 28 on a joining member 29 scraping or striking against the inner casing wall and transmitted up by the hydraulic piston 18 and the hydraulic cylinder 19. Shearing of the threaded pins 26 brings about the risk of the piston 18 prematurely sliding downwards and accidentally activating the packing and anchor mechanisms 16-17. According to an aspect of the present invention, this risk is avoided by means of an anti-setting safety mechanism which prevents any downward movement of the piston 18 on the mandrel 11 in absence of the required setting activation hydraulic pressure. This safety mechanism is embodied by a ring segmented into three virtually un-shearable parts 31 arranged equi-circumferentially in slots in the piston 18 as depicted in FIGS. 5A and 6A. FIGS. 6A and 6B show the preferred shape and proportions of these annular segments 31.

Figure 5B:
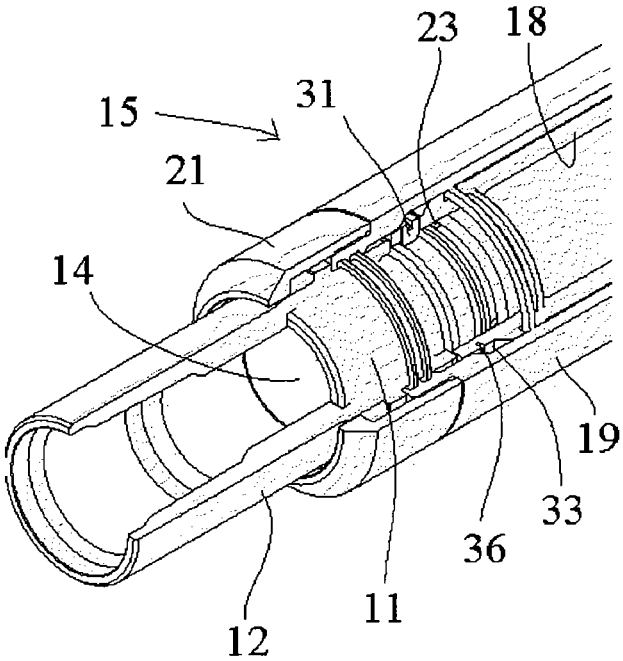
FIG. 5B is a perspective view analogous to FIG. 5A of the hydraulic mechanism of FIG. 2B showing relocation of the annular segments when setting is activated according to the present invention.

The annular segments 31 protrude radially inwards from the piston 18 fitting into a circumferential slot 32 formed on the outer wall of the mandrel 11 about 10 mm wide and chamfered edges as do the annular segments 31 too (more clearly visible in FIG. 6B) so as to interlock the piston 18 and the mandrel 11 to prevent relative axial movement therebetween. At the same time, the hydraulic cylinder 19 acts as a "roof" confining the segments 31 to prevent them from leaving the slots 32 in the mandrel 11. As a consequence, the piston 18 may not exert a force necessary to shear the threaded pins 26 to enable tool setting. The only way the segments 31 may leave the slot 32 and free the piston 18 is for the cylinder 19 to rise so that the complementary geometries of the cylinder 19 and the piston 18, in particular at given conical stepped body portions 37 proximate to where the segments 31 are lodged during run-in, create a space 33—as may be seen in FIG. 2B—sufficient for the segments 31 to leave the slot 32, as may be seen in FIG. 5B, and free the piston 18. However, the cylinder 19 may only budge by effect of the hydraulic pressure in the chamber 22, since the safety pins 26 prevent any undue ascent thereof This segmented ring 31 system facilitates tool travel through zones of the casing where the diameter is restricted, without the tool setting prematurely.

The segmented ring 31 has a small circumferential notch 34 on its outer cylindrical surface and which continues around the intervening mandrel surface for a retainer ring 36 that softly maintains the annular segments 31 in place through the piston 18 and in the slot 32 when putting the tool together. It is an open ring 36 of relatively thin wire which easily yields and opens when pushed outwards by the annular segments 31 as soon as the latter are freed by the ascending cylinder 19. Suitable dimensions for the open ring 36 are about 1.75 mm in wire diameter, about 77.0 mm and about 80.4 mm inside and outside diameters, respectively, of the ring 36 and 5 mm separation between its open ends 37 when relaxed.

FIG. 3A shows the packing mechanism 16 comprising three rubber packer seals 38 made of NBR (Nitrile Butadiene Rubber) elastomer, separated by sliding spacer rings 39 and mounted to a seal-holder collar 41 which is engaged by the piston 18 via the joining member 29. The joining member 29 has a calibrating ring 28 screwed thereon to adjust the amount of deformation of the packer seals 38 into the annular space between the tool and the casing during the set operation. The section of the packer seals 38 includes a chamfered surface 42 which emerges first in response to pressure applied by the joining member 29, as FIG. 3B illustrates, so that a circumferential lip 43 makes first contact and continues to deform against the inner wall of the casing to form a hermetic seal. Once in the set position, the packer seals 38 remain pressed against the casing wall, blocking passage of fluids from one side to the other of the packing 38 in the axial direction of the well.

Figures 8A, 8B:
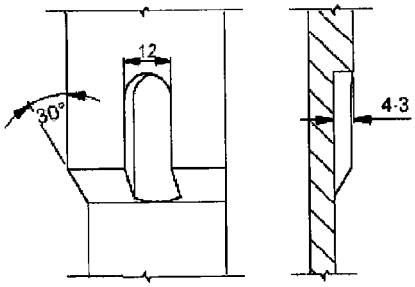
FIGS. 8A and 8B are respective section and plan views of one of the slots in FIG. 7 according to the present invention.
Figure 7:
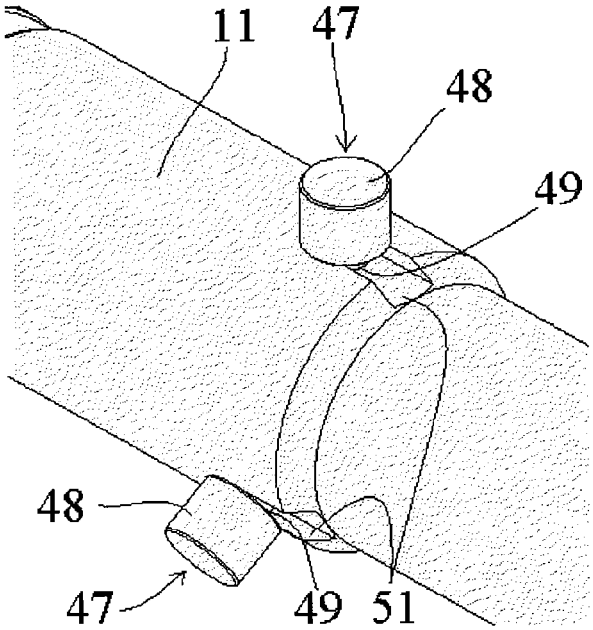
FIG. 7 is a magnified perspective view of part of the mandrel of the tool of FIG. 1A showing two of the three anti-release safety pins according to the present invention located in their slots prior to the tool set position.

According to a feature of the present invention, three anti-release safety pins 47 are fitted in round holes 46 perforating the seal-holder collar 41. Each pin 47 is made of SAE 4140 tempered steel and is formed with a cylindrical or slightly frustoconical stud 48 about 11.0 mm in diameter and about 4.5 mm length and a head 49 which is also cylindrical but larger both in length and section as FIG. 7 shows, measuring about 19.5 mm in diameter and about 15.5 mm long, forming a smooth piece which is highly resistant insofar it is dimensioned so that the head-stud 49-48 transition is be virtually unyielding to shear forces. The head 49 fits snugly in the round orifice 46 through the packing-holder collar 41 and the stud 48 in a respective longitudinal slot 51 machine-cut in the mandrel 11 as illustrated in FIGS. 8A and 8B. The slot 51 is about 29 mm long, about 12 mm across and about 4.3 mm high in the illustrated embodiment.

Since these pins 47 are smooth, a cylindrical cover 52 is provided to retain them and prevent them from falling out of the orifices 46. In turn, the cover 52 is held in place by three stud bolts 53 screwed on to an upper superior 56 forming part of the anchor mechanism 17, which detailed further on hereinafter.

In FIGS. 3A and 7, the studs 48 of the pins 47 are constrained by the corresponding machine-cut slots 51, thereby locking the mandrel 11 against rotation in relation to the combined packing-anchor mechanisms 16-17 (and, hence, relative to the well). The smooth anti-release pins 47 further prevent relative rotation between the tool ends, that is between the subs 12 and 13, thereby conveying greater reliability to connection and rotation operations on the upper and lower tubing components during mounting at the mouth of the well and later run-in.

When the piston 18 advances downwards to activate tool setting, the axial downwardly displacement of the seal-holder collar 41 moves the studs 48 of the pins 47 out of these slots 51, as seen in FIGS. 3B and 8, such that they now have room to turn on the mandrel 11. As described further hereafter, the release movement is based on a rotation of the mandrel 11 relative to the combined mechanism 16-17, such that the smooth pins 47 prevent accidental occurrence of the release turning movement if the tool has not been previously set. This means that reliability against accidental release depends no more on a single shear-pin release system such that pressure variations which appear either inside or outside the tubing do not affect proper operation of the anchor slips nor of the packing seals mechanisms 16-17 any more.

FIG. 4A shows the mechanism 17 of the packer tool for anchoring the tool, comprising: upper and lower cones 56 and 57, individually slidable axially downwards to respectively activate tool setting and release, anchor slips 58 equi-circumferentially distributed around the mandrel 11 and slidable on ramps 59 machine-cut in the cones 56 and 57, and a slips cage 61 with individual windows 62 through which the anchor slips 58 may project. This 5½" diameter tool set forth herein by way of example has three anchor slips 58 arranged at 120° from one another around the mandrel 11 although larger tools may have four or five anchor slips 58. Each anchor slip generally has a pair of horizontal and parallel teeth sets 63 with sharp edges 64 that bite into the casing wall in the set position and hold the tool fast. Each set 63 spans an outer cylindrical face measuring 60 mm×46 mm on a slip member 66 (alphabetical suffixes A, B . . . are omitted when the reference is general), each pair of members 66 of a given slip 58 being longitudinally spaced from and joined to one another by a bridge 67, all integrated into a single slip piece made of cemented SAE 8620 steel.

The anchor slips 58 are initially retracted inside the cage 61 where they are protected during the run-in. The setting operation involves pushing the anchor slips 58 out of the windows 62 to contact the casing wall. In spite of precautions, the anchor slips 58 may suffer damage anyway from different excessive mechanical or thermal conditions to which the tool is exposed during the run-in and, specially, during the lengthy period it dwells inside a well.

Failure of an anchor slip 58 may cause its teeth 64 to lose grip on the casing wall and the broken anchor slip to fall back inwards. The eventual loss of contact of an anchor slip 58 loosens the pressure of the remaining anchor slips on the casing wall, which may eventually lead to ineffectual setting of the tool.

Figure 9:
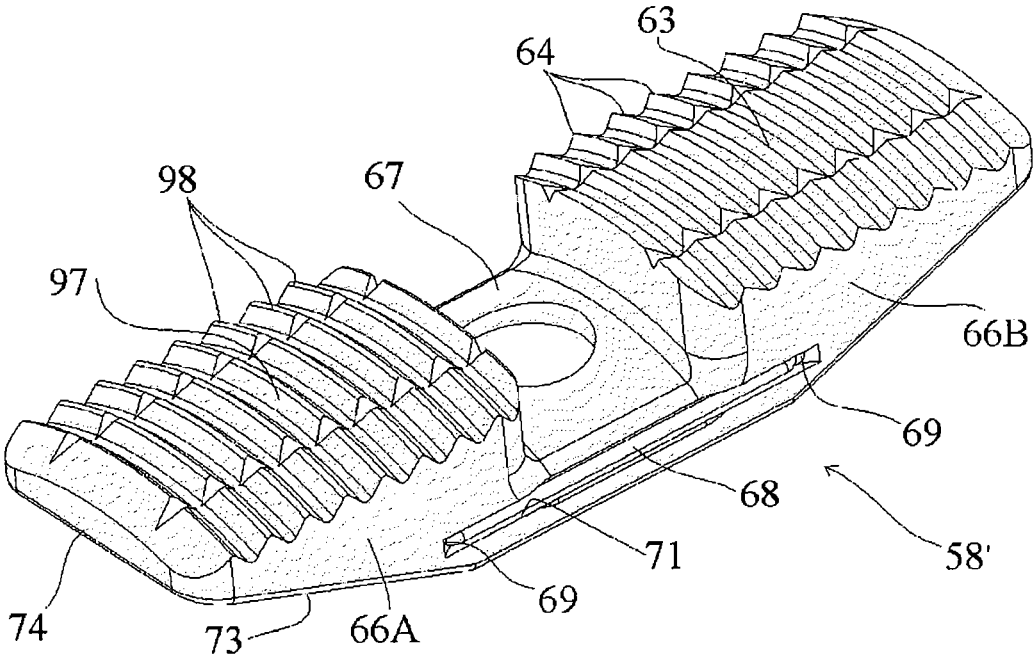
FIG. 9 is a perspective view of an anchor slip unit with a dummy slip member and an anti-fracture device.

To prevent this event, a pair of external linkage means 68 separate from the bridge 67 and having different structural and mechanical properties are placed along each side of each anchor slips 58 and its end are connected to slip members 66 as shown in FIG. 9. Each link 68 is a steel bar 68 of stainless steel—such as SAE 1020—for greater ductility, having a cross-section of 2 $mm^2$ and its ends are bent 90° and inserted in holes 69 made in each slip member 66. The sidewalls of the slips 58 have grooves 71 for housing the linkage bars 68 and keep them in the holes 69 of the anchor slips 58. In this way, the cemented steel material contributes its typical hardness to anchor slips 58 and the external linkage bars 68 relative ductility less prone to failure from jarring and thermal excursions which may fracture an anchor slip 58.

The bridges 67 of the slips 58 are not thermally treated and hence remain ductile. First, the entire piece 58 is cemented, then only the region of the teeth 63 is induction- or flame-heated and the entire piece 58 is tempered. In this way, the slips 58 are hard in the region of the teeth 63 and ductile in the region of the bridge 67 so that, in spite of the latter being the narrower part of the piece 58, a fracture is more likely to occur in the region of the slip members 66. As a result, should a substantial part of an anchor slip 58 fracture, the bars 68 will keep the members 66 linked together preventing the broken part from separating. This provides a two-fold advantage of keeping the slip members 66 together and avoiding a big broken slip part from getting in the way of tool operations such as preventing the tool from setting properly. In addition, the loose insertion of the linkage bar 68 ends in the slips member holes 69 provides some articulation as opposed to the rigidness of the bridge 67 connection.

Resuming the description of the setting operation, the pressure inside the hydraulic chamber 22 generates two opposing forces, one upwards and the other downwards. The former acts on the hydraulic cylinder 19, pushing it upwards, and the downward force on the hydraulic piston 18, urging it downwards. These opposing forces shear the safety pins 26 and enable the hanger cap 21 and the hydraulic cylinder 19 to lift. The annular segments 31 are thereby free to leave the slot 32 in the mandrel 11, unrestraining the piston 18. As the piston 18 starts sliding downwards driven by the pressure in the hydraulic chamber 22, after the three ring segments 31 have been freed as shown in FIG. 2B, it pushes the rubber seals 38 downwards. Before deforming substantially as shown in FIG. 3B, the seals 38 transmit this force via a lower calibrating ring 72 to the upper cone 56 which, in turn, forces the slips 58 outwards in a direction perpendicular to the tool axis. This is as a result of the direction of movement being changed from axial to radial by the upper cone 56 wedging under the upper members 66A of the slips 58 which have an inner surface 73 in the shape of a curved ramp. The radial slip expansion continues until it reaches the inner diameter of the casing with a force that sets the packer tool in the position depicted in FIG. 4B. A wedge-shape 74 formed on the lower slip member 66B is concurrently forced up a cylindrical ramp 76 on the lower cone 57 and also assists in pushing the slips 58 outwards. The lower cone 57 is provided with three stops 77 spaced equi-circumferentially on its bottom edge which abut against three snugs 78 formed on the surface of the mandrel 11. In the preferred embodiment, the cone ramps 73 y 76 and the slip 66 wedges have inclinations of approximately 20° relative to the axial direction and the snugs 78 define an imaginary outer diameter of about 82.5 mm. Once the slips 58 are set, the upper cone 56 may descend no more such that the entire axial force from the still down-moving piston 18 now compresses the seals 38, expanding their diameters and causing them to seal against the casing.

Figure 10:
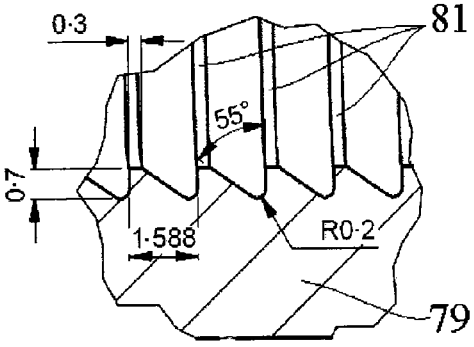
FIG. 10 is a magnified detail of a ratchet tooth impeding reverse motion of the piston in FIG. 3B.

As the piston 18 moves down it also drives an open ring 79 downwards. The open ring 79 is provided with sawtooth-like inside teeth 81 which mesh with matching ratchet teeth 82 carved on the mandrel 11 in the path of the ring 79. The meshing teeth 81-82 which define a ratchet are formed by reverse-tap screws having 16 threads per inch (pitch=1.588 mm) on the ring segment 79 and the mandrel 11. FIG. 10 illustrates the geometry and dimensions in millimeters of the anti-retreat teeth 81 formed on the ring segment 79. This ratchet prevents the piston 18 from reversing back up and enables the tool to remain properly set and sealed once the hydraulic chamber 22 has depressurized, hydraulically isolating the upper and lower parts of the tool. FIG. 2C indicates the end positions of the lowered piston 18 and of the raised hydraulic cylinder 19 after the fluid has evacuated the chamber 22.

As with the upper calibrating ring 28, the dimensions of the lower calibrating ring 72 can be adapted to individual well conditions.

Accordingly, in this preferred embodiment, the setting mechanism—the first fundamental operation in a useful cycle of a tool of this type—essentially comprises the hydraulic chamber 22, the hydraulic cylinder 19, the piston 18, the joining member 29 with its calibrating ring 28, the three rubber packer seals arranged about the seal-holder collar 41 of the packing mechanism 16, the cylindrical cover 52, the upper cone 56 and the three anchor slips 58. To prevent undue activation of the tool setting mechanism absent the required hydraulic pressure in the chamber 22 according to the invention, the anti-setting safety mechanism comprises three annular segments 31, the circumferential slot 32 in the outer wall of the mandrel 11 and the geometries of the cylinder 19 and the piston 18 which complement each other when the moment arrives to generate space 33 for the annular segments 31 to eject.

The second fundamental operation in the tool cycle is release, which consists in moving the lower cone 57 retained by the snugs 78 downwards to allow retraction of the anchor slips 58 and the rubber packer seals 38. Tool release begins by effectively rotating the tubing 60° to the right. This rotation may only be applied to the mandrel 11 if the tool is in the set position leaving the anti-release safety pins 47 out of their slots 51 shown in FIG. 8, as described hereinbefore. The necessary torque for the mandrel 11 to rotate is given by the number of shear pins 83 screwed into the lower sub 13 which holds the mandrel 11 fast to the lower cone 57 and the lower sub 13.

Figure 11A:
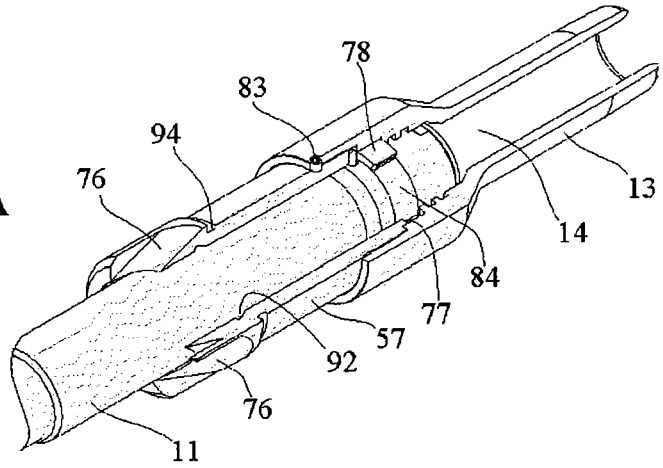
FIG. 11A is a perspective view showing the geometry of the lower cone without slips and the bottom part of the mandrel that come into play for the release movement of the mandrel, and also showing the anti-resetting mechanism, according to the present invention.
Figure 11B:
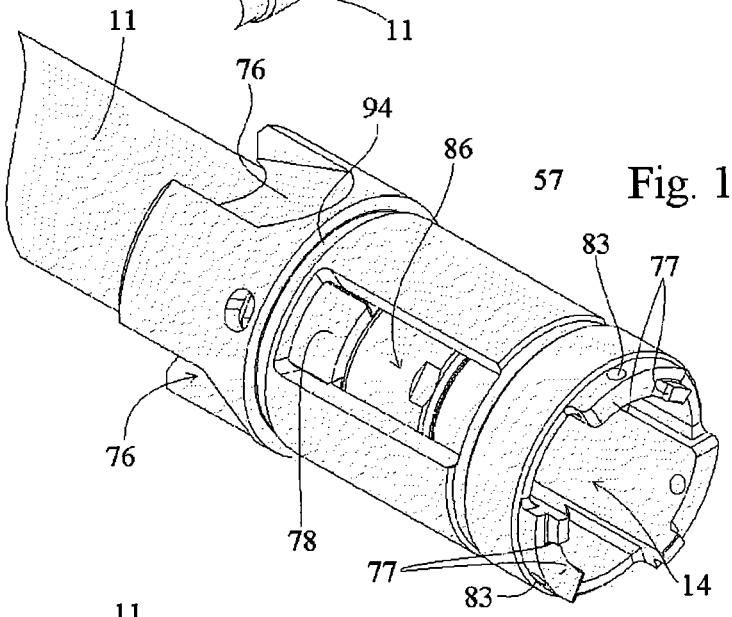
FIG. 11B is a perspective view of the bottom part of the mandrel inside the lower cone in the set position, according to the present invention.
Figure 11C:
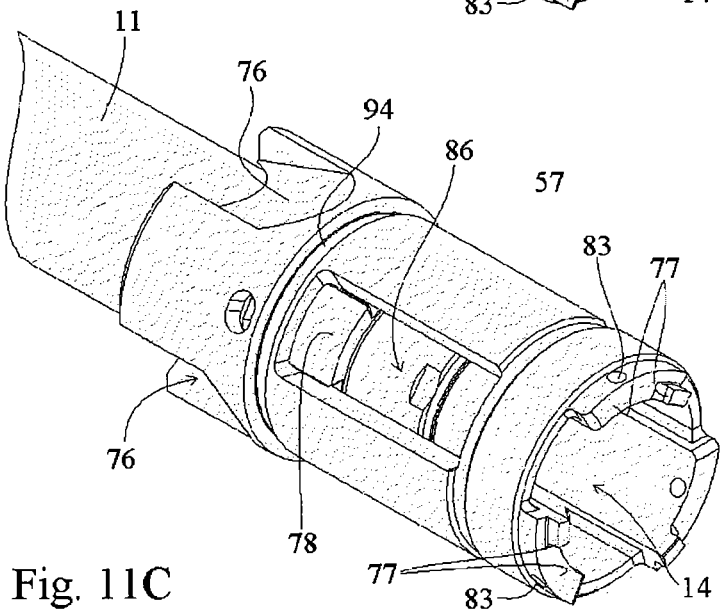
FIG. 11C is analogous to FIG. 11A except that the bottom part of the mandrel is showed in the release position inside the lower cone, according to the present invention.

The release torque applied to the mandrel 11 from above the well first shears the safety pins 83 dimensioned to break when subject to the release torque, thereby enabling the mandrel 11 to turn inside the lower cone 57 thereby displacing the mandrel snugs 78 from their position against the stops 77 of the lower cone 57, as may also be seen clearly in FIG. 11, to a position where the stops 77 face spaces 84 formed between the mandrel snugs 78, enabling the lower cone 57 to drop about 130 mm (5") together with the lower sub 13, sliding along the mandrel 11 to thereby trigger quick release of the tool. The guide snugs 78 of the jay 86, which come out from their locking position during setting and are guided down the slots 84 cut out in the lower cone 57 to their release position, do so without torsionally uncoupling the mandrel 11 from the lower sub 13, thereby maintaining release control over the tool torque throughout the tool.

During the downward displacement of the lower sub 13, a notch 87 is uncovered in the jay 86 of the lower cone 57, allowing pressures to equalize inside the tool and in the annular spacing. This situation enables forced circulation of clean fluid between the tubing and the annular, and towards the surface to wash the length of the tool.

The lower cone 57 has a step 88 which, as the cone 57 slides down the mandrel 11, strikes a complementary step 89 formed in its path on the slips cage 61, dragging it down together with the anchor slips 58. As the lower cone 57 descends, the anchor slips 58 loose their foothold on the lower cone 57 and slide along the ramp 76 thereof allowing the anchor slips 58 to retract again against the mandrel 11. The packer thus becomes unset from the casing. The upper cone 56 also descends a short distance, enough to decompress the rubber packer seals 38, such that the radial length increases again at the expense of a diminishing diameter and become unsealed. The tool is thus fully released regarding both the anchor and packing mechanisms 16-17.

Since pressure conditions down the borehole as well as mechanical friction during tool extraction could push the lower cone 57 back upwards after release, spontaneously resetting the tool sufficiently to impede extraction or otherwise make it more difficult, the present invention provides a safety system against undesirable reactivation of the setting mechanism by providing a restrainer against eventual reversal motion of the release mechanism. The release mechanism essentially comprises the lower cone 57 and associated means that control and participate in the downward movement just described hereinbefore. This restrainer prevents the lower cone 57 from sliding back upwards back along the mandrel 11 thereby avoiding another setting post tool release. The anti-post-release-resetting restrainer comprises an expansible ring 91 around the mandrel 11 nestled inside a small triangular recess in the inner surface of the lower cone 57 to define a transversal step 93. When the cone 57 slides downwards, it drags the restrainer ring 91 down with it until the latter lodges in a circumferential notch 94 formed on the wall of the mandrel 11, as FIG. 4C illustrates, transforming the ring 91 into a safety lock which prevents the lower cone 57 from being able to move back up again under any circumstance once the ring 91 penetrates the notch 94. Hence, the tool may be reliably handled once released.

In this preferred embodiment, the restrainer ring 91 is 4 mm thick and 8 mm wide whereas the depth of the notch 94 reduces this part of the diameter of the mandrel 11 down to about 67 mm (2.6"). This measurement is a trade-off between the need of sufficient notch depth to catch the ring 91 without unduly weakening the wall thickness of the mandrel 11.

As in the setting maneuver, the complementary steps 88-89 become axially apart as illustrated by FIG. 4B and meet again as the lower cone 57 comes down in a manner which sometimes may be hard enough to fracture the anchor slips 58. A buffer or damper means formed by a rubber ring 96 is located between the pair of steps 88-89. Preferably, the ring 96 is made of acryl-nitrile D-90 and has a square or rectangular cross-section of about 6.7 mm wide and about 94.3 mm and about 105 mm inner and outer diameters, respectively.

Describing the anchor slips 58 in greater detail, FIG. 10A exhibits a typical, bidirectional anchor slip 58 having gripping teeth 64 shaped in a triangular cross-section slanted towards a preferred orientation, i.e. like a saw-tooth, in order to oppose substantial frictional resistance against a prevailing axial direction against the casing of the well, compared to the opposite direction. In each typical anchor slip 58, the preferred slant direction of the teeth 64 of one set 63 is opposite to the other so as to maximize the tool setting power against the casing wall by virtue of both sets of oppositely slanted teeth 63 forming part of the same rigid piece 58. In the embodiment illustrated in FIGS. 4A, 4B and 4C, the upper teeth 63 are set against descent and the lower teeth 63 against ascent.

Figure 12A:
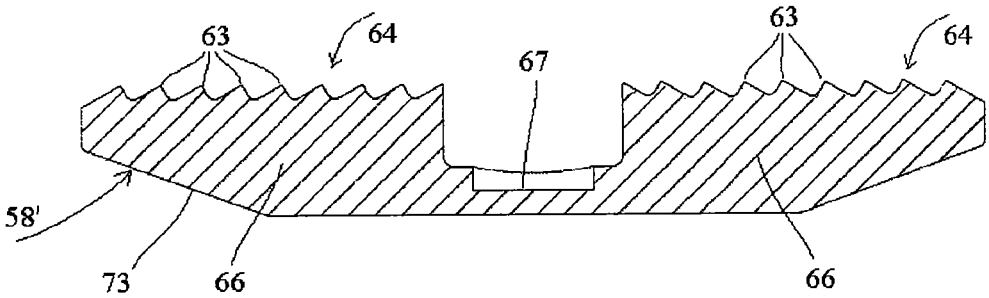
FIG. 12A is a cross-section of a typical bidirectional symmetrical anchor slip.
Figure 12B:
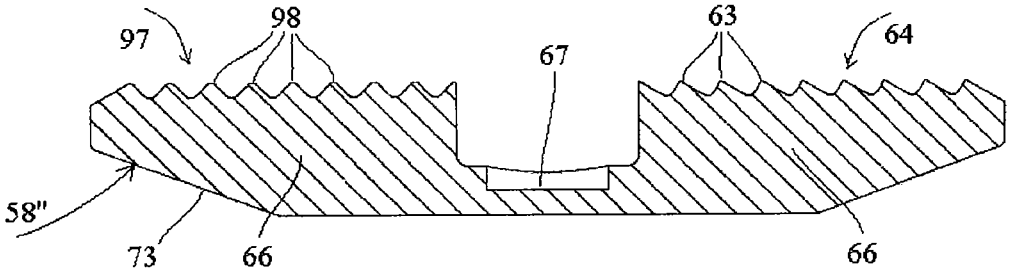
FIG. 12B is a cross-section analogous to FIG. 12A of an asymmetrical anchor slip having one set of typical teeth and one set of dummy teeth.

One of the anchor slips 58' comprises unidirectional teeth 64 in one set and "dummy teeth" 97 as the other. The latter are characterized by blunt rather than sharp edges 64, for instance by termination in rounded edges 98 when compared to the sharp teeth 64 of the rest of the anchor slips 58. In addition, the "dummy teeth" 97 furthermore lack a preferred orientation of the teeth 97, rather they are symmetrical, i.e. not slanted, as FIG. 12B shows, in contradistinction to the typical teeth 64 with a preferred orientation shown in FIG. 12A. I estimate that the radius of the cylindrical curvature of the rounded edges 98 should not be less than about 0.4 mm, preferably not less than about 0.8 mm, to meet the object of the invention. In other words, the set of dummy teeth 97 opposes scant resistance in either axial direction against sliding along the casing wall.

This overcomes the potential problem of the teeth 64 "merging" or "integrating" with the casing after a long period of being together in the same biting position. What happens is that, as an anchor release operation begins, the typical set of teeth 64 which partner the set of dummy the teeth 98 becomes unstuck freely and separates from the casing promoting immediate collapse of the typical-dummy pair 58' such that this slip releases first. The loss of a bearing point of the packer tool provides a degree of freedom for transversal movement of the tool to release the two remaining anchor slips 58 with no difficulty.

On the other hand, the "dummy" teeth 98 carry out a secondary function by applying a radial force on the casing wall which balances out the radial forces exerted by the "typical" teeth 64 angled at 120°.

These features convert the packer of the present invention into an efficient and reliable tool during run-in, setting and release, applicable to well completions requiring lowering, affixing and recovering multiple packers in a single voyage of the tubing, such as in water injection and in hydrocarbon production installations. The mandrel 11 in combination with the lower sub 13 may function as a telescopic joint assuring that movements applied to a particular tool which is being operated are not transmitted to tools located therebelow.

A particular embodiment of the invention has been disclosed herein, however changes in materials, shapes, sizes, geometry and arrangement of tool components may be carried out without departing from the purview of the present invention as set forth in claims that follow. For instance, a packer tool having a greater nominal diameter, e.g. 7" or 9⅝", may comprise more than three slips.

What is claimed is:

1. A packer tool for a well, said tool comprising:

a mandrel with a bore for receiving a tool-setting pressurized fluid, a hydraulic setting mechanism adapted to be driven by said pressurized fluid and packing seals around said mandrel and arranged to be set by said hydraulic setting mechanism in response to said pressurized fluid driving said hydraulic setting mechanism, said hydraulic setting mechanism comprising:

a hydraulic chamber connected to said mandrel bore for receiving said pressurized fluid, a piston slidably mounted to said mandrel and adapted to be displaced, by said pressurized fluid entering said chamber, along said mandrel in a predetermined axial direction between a run-in position and a set position causing said packing seals to set, and a safety device for retaining said piston fast against displacement in said direction relative to said mandrel until said pressurized fluid has begun to pass from said mandrel bore into said chamber, thereby preventing premature setting of said tool, wherein said safety device is immune to shear forces applied by said piston, and wherein said safety device comprises:

anti-setting segments loosely lodged in said piston and said mandrel thereby interlocking said piston and said mandrel to prevent relative axial movement therebetween in the run-in position, and a cylinder coaxial with said piston and adapted to displace along said mandrel in an axial direction opposite to said predetermined piston-displacement axial direction between a run-in position and a set position in response to said pressurized fluid entering said chamber, said cylinder forming a roof over said anti-setting segments lodged in said piston preventing said anti-setting segments from dislodging while said cylinder is in the run-in position, wherein said cylinder includes an inside step proximate to where the segments are lodged during run-in and adapted to create free space for said anti-setting segments to dislodge from said mandrel in response to tool-setting pressurized fluid entering said chamber and displacing said cylinder from its run-in position to its set position, whereby said anti-setting segments are able to dislodge to said free space thereby freeing said piston to be driven by said tool-setting pressurized fluid in said chamber to said set position.

2. The tool of claim 1, wherein said cylinder includes a conical body portion forming said inside step.

3. The tool of claim 1, wherein said piston includes a piston portion between said mandrel on the inside and said cylinder on the outside, said piston portion radially traversed by through openings for lodging a greater part of said anti-setting segments in the run-in position.

4. The tool of claim 1, wherein said anti-setting segments comprise a plurality of segments distributed equi-circumferentially about said mandrel.

5. The tool of claim 4, wherein said anti-setting segments are annular segments of a ring.

6. The tool of claim 4, wherein said anti-setting segments comprise three annular segments distributed at 120° from one another.

7. The tool of claim 1, wherein said mandrel has slots thereon for lodging an inside portion of said anti-setting segments in the run-in position.

8. The tool of claim 1, wherein said mandrel slots have chamfered edges.

9. The tool of claim 1, wherein said anti-setting segments have chamfered inside surfaces.

10. The tool of claim 1, further including shear pins holding said cylinder to said piston in said run-in position, said shear pins dimensioned to fail at said tool-setting fluid pressure.

11. The tool of claim 1, wherein said hydraulic setting mechanism includes at least one radial passage through said mandrel connecting said hydraulic chamber to said mandrel bore.

12. A packer tool for a well and including:

a mandrel with a bore along the inside thereof, movable means movably mounted to said mandrel and including:

a packing device comprising a holder with at least one displaceable or deformable seal thereon, a setting mechanism which, upon activation, drives said packing device to force said seals outwards from said mandrel from a run-in position to a set position, and a mechanical release mechanism slidably mounted to said mandrel and adapted to, in response to rotation of said mandrel through a predetermined angle relative thereto, slide along said mandrel from a set position to a release position enabling retraction of said seals towards said mandrel, and a release safety device for preventing said mandrel from rotating relative to said release mechanism and including:

slots formed in one of said mandrel and said movable means and facing the other one of said mandrel and said movable means, said slots extending an axial distance and open at one end thereof to a free rotation region, through holes formed in said other one of said mandrel and said movable means un-shearable release safety pins loosely housed in respective ones of said through holes and extending towards and into respective ones of said slots to be retained therein against rotation when said tool is in said run-in position, and a cover over said through holes to confine said safety pins and through holes, whereby said setting mechanism, upon activation, further drives said un-shearable safety pins towards said open slot ends and out of their corresponding slots, thereby enabling rotation of said mandrel through said predetermined angle relative thereto cause said release mechanism to slide along said mandrel to said release position.

13. The tool of claim 12, wherein said tool includes an anchor mechanism and said setting and said release mechanisms comprise cones slidably mounted to said mandrel for respectively setting and releasing said anchor mechanism.

14. The tool of claim 13, wherein said movable means comprises a plurality of said through holes for housing said release safety pins and wherein:

said slots are formed on said mandrel towards said release mechanism, and each of said un-shearable release safety pins comprise a head loosely housed in one of said through holes and a stud for penetrating one of said slots to lock said mandrel to said release mechanism cone against rotation.

15. The tool of claim 14, wherein said tool further comprises a packing holder collar, said through holes are formed in said packing holder collar and said cover surrounds a portion of said collar to cover said safety pins and confine said safety pin heads to said round collar holes.

16. The tool of claim 14, wherein said holes are round and said safety pin heads and studs are approximately cylindrical, said safety pin heads being substantially longer than said safety pin studs.

17. The tool of claim 16, wherein said release safety pin heads and studs are smooth.

18. A packer tool for a well, said tool including:

a mandrel with a bore along the inside thereof, an anchor mechanism, a packing device comprising a holder with at least one displaceable or deformable seal thereon, a setting mechanism which, upon activation, drives said packing device to force said seals outwards from said mandrel from a run-in position to a set position, a mechanical release mechanism slidably mounted to said mandrel and adapted to, in response to rotation of said mandrel through a predetermined angle relative thereto, slide along said mandrel from a set position to a release position enabling retraction of said seals towards said mandrel, said release mechanism including a release cone slidably mounted to said mandrel for releasing said anchor mechanism in said release position, and locking means arranged between said release cone and said mandrel and having an initial unlocked position when said tool is in run-in and set positions and an end position when said tool is in a release position, wherein said locking means is adapted to move from said initial position to said end potion by sliding along said mandrel driven by said release mechanism and, upon reaching said release position, retaining said release mechanism from slidably retreating back along said mandrel towards said set position, wherein said locking means comprises:

an expanded ring mounted around said mandrel and joined to said release cone, and a circumferential notch formed on said mandrel for catching said expanded ring as the ring slides down said mandrel dragged by said release cone.

19. The tool of claim 18, wherein said locking means further includes a step formed on said release cone, said expanded ring nestled against said step, whereby said release cone drags said expanded ring with the release cone as the release cone slides along said mandrel.

20. The tool of claim 19, wherein said cone step is part of a recess formed on the inside of said cone.

21. The tool of claim 19, wherein said expanded ring has a right-angled triangular cross-section and said cone recess has a similar right-angled triangular shape.

22. The tool of claim 18, wherein said locking means reaches said end position as said packing seals reach their release position.

* * * * *